United States Patent [19]

Ruger et al.

[11] Patent Number: 4,835,892

[45] **Date of Patent: * Jun. 6, 1989**

[54] MAGAZINE LATCH FOR PISTOL

[75] Inventors: William B. Ruger, Croydon, N.H.; Lawrence L. Larson, Branford, Conn.

[73] Assignee: Sturm, Ruger & Company, Inc., Southport, Conn.

[ * ] Notice: The portion of the term of this patent subsequent to Dec. 6, 2004 has been disclaimed.

[21] Appl. No.: 624,200

[22] Filed: Jun. 25, 1984

[51] Int. Cl.[4] ..... F41C 25/06

[52] U.S. Cl. ..... 42/7

[58] Field of Search ..... 42/7

[56] References Cited

U.S. PATENT DOCUMENTS

| | | | |
|---|---|---|---|
| 3,715,826 | 2/1973 | Seifried | 42/7 |
| 4,326,353 | 4/1982 | Ludwig et al. | 42/7 |
| 4,521,985 | 6/1985 | Smith et al. | 42/7 |

FOREIGN PATENT DOCUMENTS

| | | | |
|---|---|---|---|
| 3300614 | 8/1983 | Fed. Rep. of Germany | 42/7 |

OTHER PUBLICATIONS

High Standard Sporting Firearms—1975, "Pistols of the World"—Hogg et al., cover and p. 137.

*Primary Examiner*—Charles T. Jordan
*Attorney, Agent, or Firm*—Pennie & Edmonds

[57] ABSTRACT

An ambidextrous magazine latch arrangement for a pistol in which a hand-operable cross lever is positioned by resilient means against a frame portion of the pistol handle with lever ends protruding on either side of the handle. The lever has a latch protrusion which protrudes into the magazine to hold the magazine. By applying hand pressure to either lever end the lever twists against the resilient means to withdraw the latch protrusion out of the magazine to release the magazine.

7 Claims, 3 Drawing Sheets

MAGAZINE LATCH FOR PISTOL

BACKGROUND OF THE INVENTION

Numerous arrangements have been proposed for latching a magazine in a pistol so that the magazine is held in place during operation and is releasable from the pistol for withdrawal and replacement.

Most magazine latches are positioned on, or readily accessible from, one side or the other of the pistol. The operator must learn to use his left or his right hand to operate each particular latch. Some latch positions and method of operation favor right-handed operators and do not favor left-handed operators. Also, some magazine latches can be converted from full-time right-hand operation to full-time left-hand operation, but these do not permit simultaneous full-time operation by either hand.

None of the so-called ambidextrous magazine latches function in the manner of the present invention.

SUMMARY OF THE INVENTION

Broadly, the present invention is an ambidextrous lever arrangement in which a hand-engaging operable latch head which protrudes from each side of the pistol is mounted on and acted upon by a resilient spring-loaded unit positioned in the pistol handle frame. A magazine-engaging projection on the latch head extends into a slot in the magazine to hold the magazine in operable position. Applying hand pressure to either side of the latch head causes it to move away from the magazine a sufficient distance to move the projection out of the magazine and release it.

It is a feature of the invention that the latch head is readily operable from either side of the pistol with either the right or left hand, without the necessity of having to disassemble the magazine latch and reassemble it to operate from the opposite side of the pistol.

It is also a feature that the width of the grip frame permits the latch head to be pivotably operated in selected embodiments.

DETAILED DESCRIPTION OF THE PREFERRED EMBODIMENTS

Figure 1:
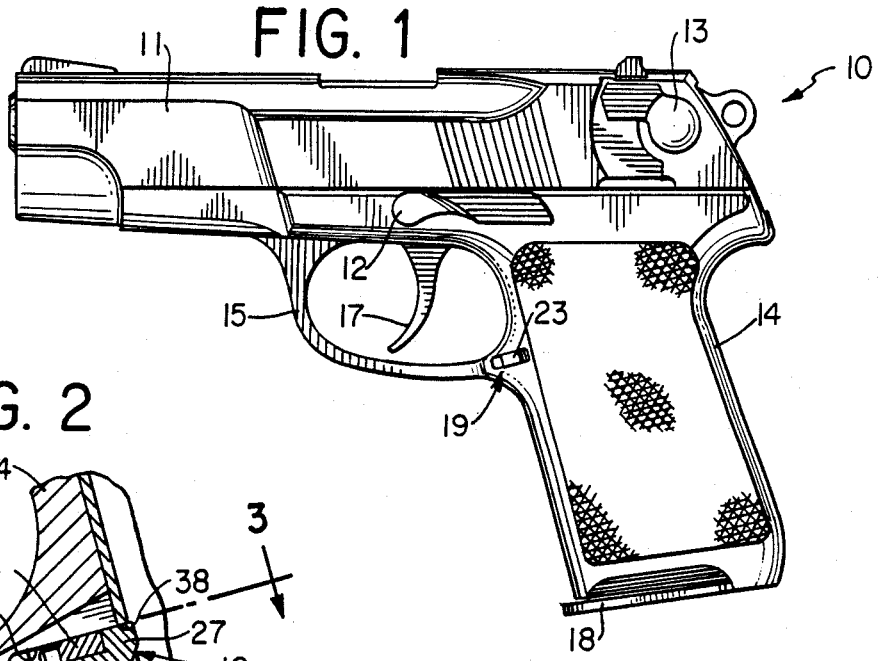
FIG. 1 is a side elevational view of the pistol having the latch arrangement of the invention.

In FIGS. 1–6, pistol 10 includes slide 11, slide lock 12, manual safety 13, frame 14, trigger guard frame portion 15, trigger 17, magazine 18 and magazine latch head 19.

Figure 6:
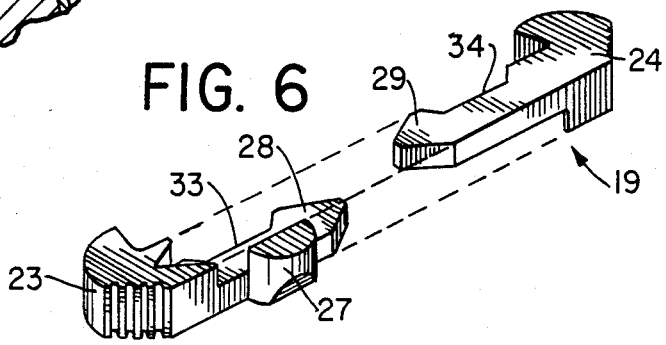
FIG. 6 is an exploded view of two (2) latch head sections.
Figure 5:
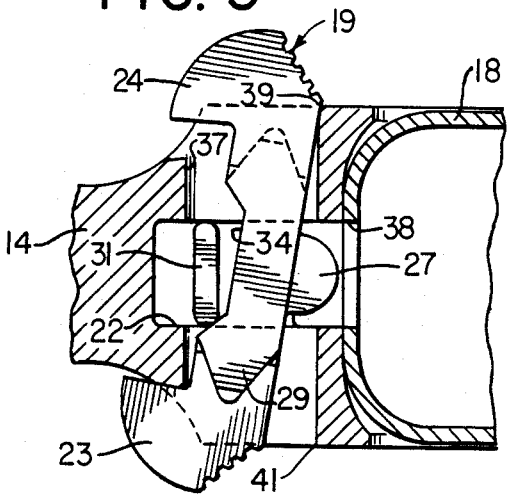
FIG. 5 is a view similar to FIG. 3 showing the latch head being twisted to release the magazine.

Magazine latch head 19 is mounted in an elongated cavity 22 in frame 14 adjacent trigger guard frame portion 15. Latch head 19 consists of two (2) headpieces 23, 24 with headpiece 23 carrying magazine latch projection 27. Headpieces 23, 24 each have complementary superimposable interfitting portions 28, 29 respectively (FIG. 6).

Figure 2:
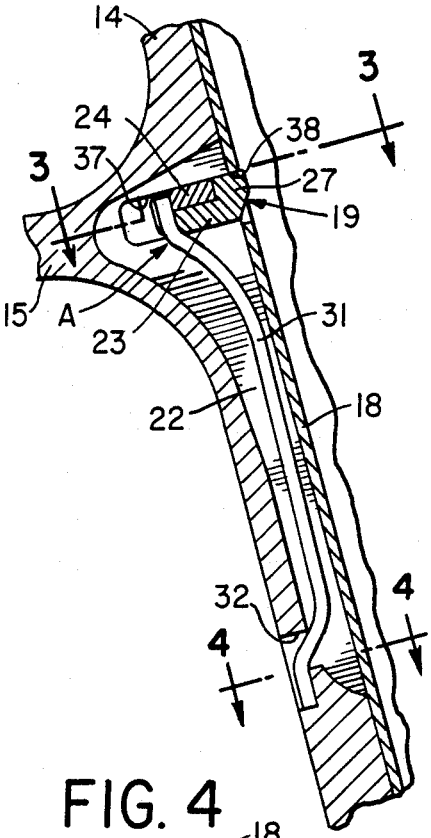
FIG. 2 is a partial sectional view showing the latch in the handle frame cavity.

Portions 28, 29 are held together in their assembled position by elongated spring 31 which is mounted in mounted slot 32 in the lower portion of frame cavity 22 and is urged in the direction of arrow A (FIG. 2). The upper end of spring 31 is held under tension in indented recesses 33, 34 of portions 23, 24 respectively. Slot recesses 33, 34 are superimposed one above the other as assembled (see FIG. 3). Frame cavity 22 includes an upper spring guide slot 37 which guides spring 31 as it is deflected away from the magazine through twisting of head 19 (see FIG. 5).

Figure 3:
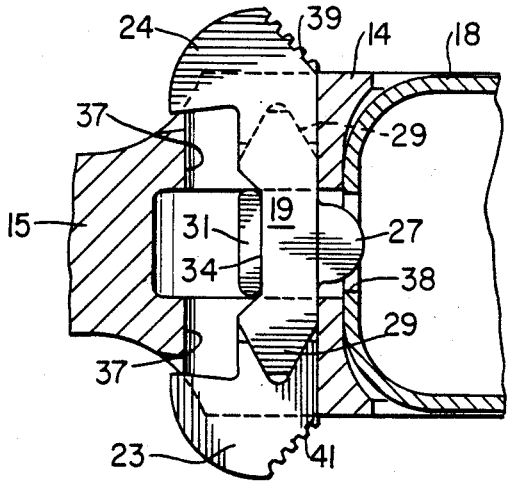
FIG. 3 is a section along line 3—3 of FIG. 2.
Figure 4:
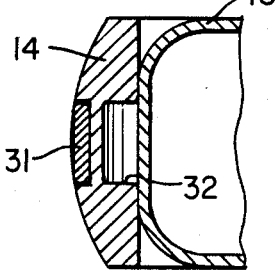
FIG. 4 is a section along line 4—4 of FIG. 2.

With particular reference to FIG. 3, latch projection 27 projects into magazine opening 38 and holds magazine 18 in the pistol handle. The head 19 rests against pistol frame 14 under urging of spring 31. When it is desired to remove the magazine 18, the head 19 is twisted by placing a hand on portion 23 (or 24) to push (or pull) the head 19 generally away from magazine 18, causing the head 19 to rotate about one of the frame pivot positions 39, 41 depending on which side (portion 23, 24) of head 19 is pushed (or pulled). Spring 31 moves back in guide slot 37 and magazine latch projection 27 moves clear of slot 38 to release magazine 18 (FIG. 5) Pivot positions 39 and 41 are spaced apart a sufficient distance to provide for proper pivoting action of the latch head. After removal of magazine 18, the head 19, as urged by spring 31, is returned to its rest or latched position.

Figure 7:
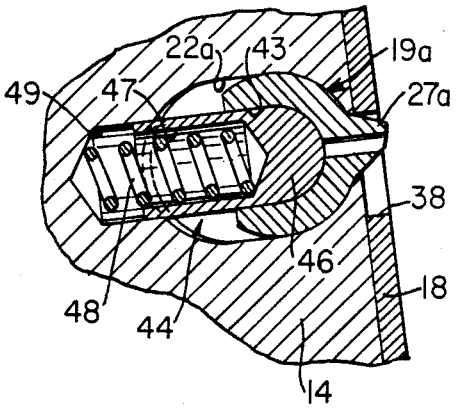
FIG. 7 is an enlarged sectional view of FIG. 8 showing an alternative embodiment.
Figure 8:
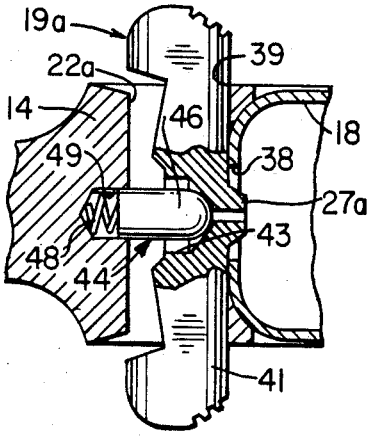
FIG. 8 is a sectional view of the alternative embodiment.

Turning now to FIGS. 7 and 8, and a second alternative embodiment, a unitary latch head **19*a* is substituted for head 19. Latch head 19*a* is positioned in frame cavity 22*a* and carries latch projection 27*a*. Latch head 19*a* has in its center portion a detent-receiving opening 43. Detent 44 has detent nose 46, detent recess 47 and detent coil spring 48. Detent chamber 49 in frame 14 houses detent 44 and coil spring 48 to urge latch head 19*a* against frame 14. The operation of this embodiment is similar to the embodiment of FIGS. 1–6 in that the operator applies a force to either end of latch head 19*a*causing the head 19*a* to twist and rotate about pivot 39 (or 41) allowing latch projection 27*a* to move to the left (FIG. 8) and release magazine 18**.

Figure 9:
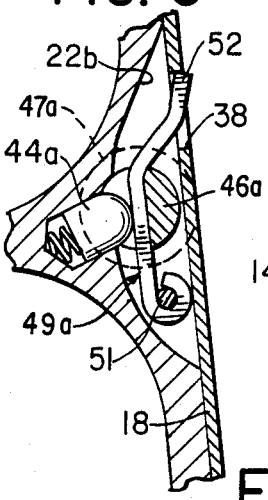
FIG. 9 is a partial sectional view of a further embodiment of the invention.
Figure 10:
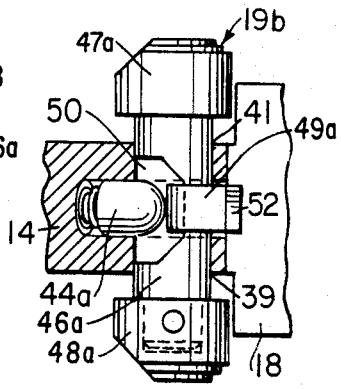
FIG. 10 is a sectional view of the further embodiment.

Turning now to FIGS. 9 and 10, latch head crosspiece **19*b* includes cylindrical central portion 46*a* and two (2) cylindrical end pieces 47*a*, 48*a*. Head crosspiece 19*b* is mounted in frame cavity 22*b*. Head crosspiece 19*b* has a recess 50 for nesting pivotable latch member 49*a*. Latch member 49*a* is pivotably mounted on pivot 51 and its lip portion 52 extends through opening 38 in magazine 18. Urging latch member 49*a* and head 19*b* against frame 14 is spring-loaded detent 44*a***.

In operation, movement of either end 47*a*, 48*a* of head 19*b* away from magazine 18 will cause head 19*b* to pivot about pivot 39 (or 41). As the pivoting of head 19*b* continues, latch head 19*b* is pulled back by central part 46*a* (FIG. 9) to withdraw lip portion 52 from interference with the magazine. Once manual force on head 19*b* has been diminished or released, spring-loaded detent 44*a* causes the head 19*b* to move back to its locked position (FIG. 10).

Figure 11:
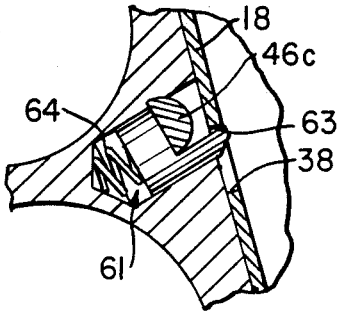
FIG. 11 is a partial sectional view of a fourth embodiment of the invention.
Figure 12:
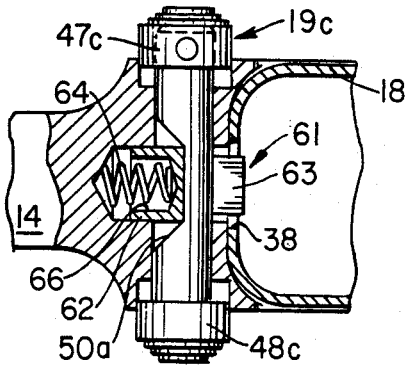
FIG. 12 is a partial sectional view of the fourth embodiment.

FIGS. 11 and 12 illustrate a further embodiment including latch head 19*c* with central portion 46*c* and two (2) end pieces 47*c*, 48*c*. Central portion 46*c* has recess 50*a* in which latch member 61 sits. Latch member 61 includes body portion 62 and magazine latch extension 63. Spring 64 in body portion recess 66 urges latch member 61 which in turn is pressed against latch head 19*c*. Operation of the embodiment of FIGS. 11 and 12 is the same as the other embodiments.

Figure 13:
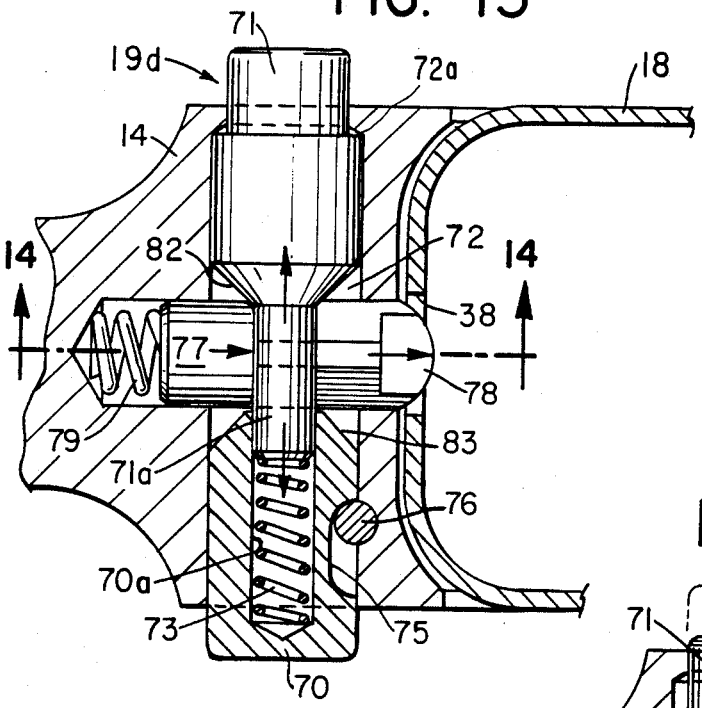
FIG. 13 is a partial sectional view of a fifth embodiment of the invention.
Figure 15:
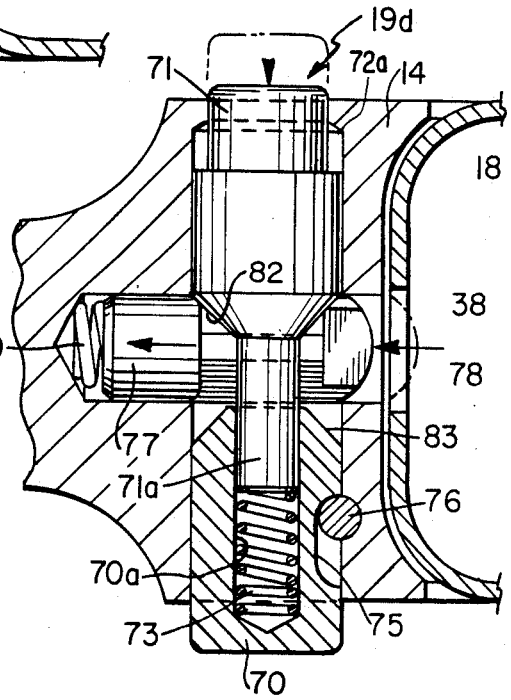
FIG. 15 is a view similar to FIG. 13 showing the operation of the embodiment.
Figure 14:
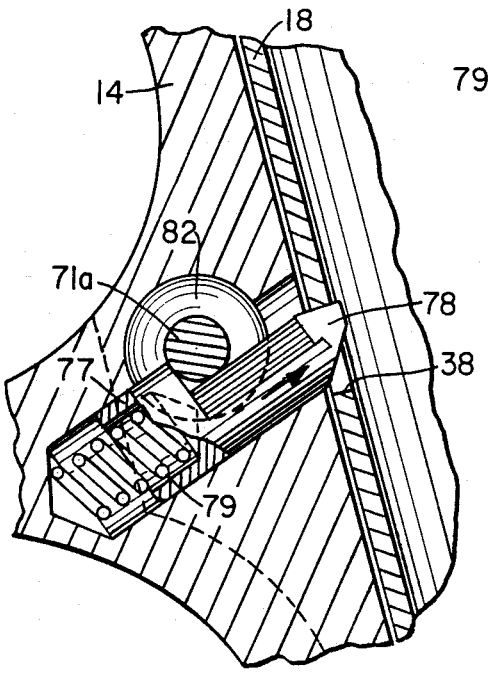
FIG. 14 is a sectional view taken along line 14—14 of FIG. 13.

Finally, FIGS. 13–15 show a further embodiment including latching head 19*d* which has two head portions 70 and 71 positioned in frame cavity 72. Head portion 71 includes neck section 71*a* which fits telescopically into head recess portion 70*a*. Coil spring 73 urges head portions 70 and 71 apart. The limit of movement of portion 71 outwardly is recess end stop 72*a*. Other head portion 70 moves outwardly until its travel limit groove 75 engages pin 76.

Latch member 77 includes magazine latch extension 78 and latch member spring 79 urging extension 78 into opening 38 of magazine 18. Latch member 77 has a notch surface 81 which, depending on its direction of movement, engages a cam surface 82 of head portion 71 or the cam surface 83 of head portion 70.

When either or both head portions 70, 71 are moved by hand force inwardly toward one another, cam surfaces 82 or 83 contact and thereafter cam against latch surface 91 causing latch member 77 to move to its unlatched position (FIG. 15). When hand force is removed, the head portions 70, 71 are urged apart by action of two (2) springs 73, 79 to accomplish the latched mode. Spring 79 urges latch member 77 and its notch surface 81 against head portion surface 82 or 83 (or both) which in turn urges head portions 70 and 72 apart. The action of two (2) springs lessens the likelihood of the latch not returning to its latched mode after it has been operated to its unlatched mode.

I claim:

1. In a pistol having a barrel, a frame which extends along an edge of and forms part of a pistol handle frame portion, a magazine on one side of the pistol handle frame portion, an opening in the magazine, a latch extending in a plane generally parallel to the barrel into the opening in the magazine, the magazine latch operating arrangement having a latch position and an unlatch position comprising (a) a planar surface area on the pistol handle frame portion such planar surface being generally perpendicular to a plane parallel to the barrel;

(b) a hand-operable pivotal cross lever normally positioned against the planar surface; the lever having a central area and ends; and the lever ends protruding on each side of the frame portion, such cross lever being pivotal about spaced-apart pivot points on such planar surface;

(c) a recess in the central area of the cross lever; and (d) resilient means in the recess for controlling movement of the cross lever as the latch operating arrangement is operated through cross lever pivoting while such resilient means normally urges the lever to its latch position;

whereby movement of either lever end causes the lever to pivot on such planar surface as the resilient means yields to movement by the lever and its latch means moves perpendicular to such planar surfaces out of the opening in the magazine thus releasing the magazine for removal from the pistol handle.

2. The latch operating arrangement of claim 1 in which the resilient means is an elongated spring with the base of such means secured below the lever and the upper portion of the spring positioned in the cross lever recess.

3. The latch operating arrangement of claim 1 in which the lever is comprised of a plurality of portions assembled together and held together after assembly by the resilient means.

4. The latch operating arrangement of claim 1 in which the resilient means is a spring-loaded detent.

5. The latch operating arrangement of claim 1 in which the latch is secured to the lever.

6. The latch operating arrangement of claim 1 in which the latch is held between the lever and the resilient means and caused to move with the lever.

7. In an arrangement for operating a magazine latch for a pistol having a pistol barrel and a handle frame having a left and a right side which magazine latch is reciprocal in a plane generally parallel to the pistol barrel and normally urged by resilient means to a latch positions, the improvement comprising (a) handle frame cavity;

(b) first cam means on the magazine latch;

(c) two telescoping latch operating elements positioned in the frame cavity with one element accessible from the right side of the handle and the other element accessible from the left side of the handle with both telescoping latch elements positioned generally perpendicular to the plane of movement of the latch;

(d) second cam means on each of the telescoping latch operating elements for engagement with the first latch cam means to move the latch to its unlatch position when either telescoping latch element is operated.

* * * * *